US008884533B2

(12) United States Patent
Zhang et al.

(10) Patent No.: US 8,884,533 B2
(45) Date of Patent: Nov. 11, 2014

(54) LIGHT EMITTING DIODE LIGHTING DEVICE AND LIGHT EMITTING DIODE LAMP

(75) Inventors: Weiqiang Zhang, Shanghai (CN); Lizhi Xu, Shanghai (CN); Jianping Ying, Shanghai (CN)

(73) Assignee: Delta Electronics (Shanghai) Co., Ltd. (CN)

( * ) Notice: Subject to any disclaimer, the term of this patent is extended or adjusted under 35 U.S.C. 154(b) by 131 days.

(21) Appl. No.: 13/572,122

(22) Filed: Aug. 10, 2012

(65) Prior Publication Data

US 2013/0278152 A1 Oct. 24, 2013

(30) Foreign Application Priority Data

Apr. 20, 2012 (CN) ..... 2012 1 0119274

(51) Int. Cl.
*H05B 37/00* (2006.01)

(52) U.S. Cl.
USPC ..... 315/185 R; 315/51; 315/86

(58) Field of Classification Search
None
See application file for complete search history.

(56) References Cited

U.S. PATENT DOCUMENTS

| | | | | |
|---|---|---|---|---|
| 5,517,086 | A * | 5/1996 | El-Hamamsy et al. | 315/247 |
| 6,605,900 | B2 * | 8/2003 | Chien | 315/86 |
| 6,621,222 | B1 * | 9/2003 | Hong | 315/51 |

FOREIGN PATENT DOCUMENTS

| | | |
|---|---|---|
| CN | 1943276 | 4/2007 |
| CN | 101990328 | 3/2011 |
| TW | 201043089 | 12/2010 |

OTHER PUBLICATIONS

Office Acton dated Jun. 23, 2014 from corresponding application No. TW 101118613.

* cited by examiner

*Primary Examiner* — Crystal L Hammond
(74) *Attorney, Agent, or Firm* — Lowe Hauptman & Ham, LLP

(57) ABSTRACT

The present application discloses a light emitting diode lighting device and a light emitting diode lamp, the light emitting diode lighting device includes: a fluorescent lamp ballast outputting an alternating current; and at least one first light emitting diode lamp coupled with the fluorescent lamp ballast, and comprising a rectifying and filtering circuit and at least one light emitting diode string coupled with the rectifying and filtering circuit. The present application directly replaces a conventional fluorescent lamp tube with a properly designed LED lamp without any other modifications when reinstallation a conventional fluorescent lamp lighting device into a light emitting diode lighting device, which may reduce the cost of reinstallation, and greatly facilitate the user.

18 Claims, 11 Drawing Sheets

LIGHT EMITTING DIODE LIGHTING DEVICE AND LIGHT EMITTING DIODE LAMP

CROSS REFERENCE TO RELATED APPLICATIONS

The present application claims priority under 35 U.S.C. §119 to Chinese Patent Application No. 201210119274.3, filed on Apr. 20, 2012, the entire content of which is incorporated herein by reference.

FIELD OF THE INVENTION

The present application relates to the technical field of lighting, and more particularly, to a light emitting diode lighting device and a light emitting diode lamp.

BACKGROUND OF THE INVENTION

Compared with the conventional fluorescent lamps, the light emitting diode (LED) lamp has many features, such as high efficiency, energy conservation, low carbon and environment protection. Under conditions of global energy shortage, the LED lighting technique attracts global attentions in the lighting market, is applied widely, and is gradually replacing the conventional fluorescent lamps. Generally, when reinstalling a fluorescent lamp lighting device into a LED lighting device, a solution of replacing a fluorescent lamp ballast and fluorescent lamp tubes shown in FIG. 1 with a LED driver and a LED lamp shown in FIG. 2 is adopted. However, in this solution, the fluorescent lamp ballast is wasted, and an additional LED driver is required, thereby the cost of reinstallation is increased. Additionally, a user needs to rewire, which makes the user inconvenient.

SUMMARY OF THE INVENTION

In order to reduce the cost of reinstalling the conventional fluorescent lamps into the LED lighting device and facilitate the users, the present application provides a light emitting diode lighting device and a light emitting diode lamp.

In one aspect, the present application provides a light emitting diode lighting device, including: a fluorescent lamp ballast; and at least one first light emitting diode lamp and/or at least one second light emitting diode lamp, coupled with the fluorescent lamp ballast; wherein the first light emitting diode lamp includes a rectifying and filtering circuit and at least one light emitting diode string coupled with the rectifying and filtering circuit; wherein the second light emitting diode lamp includes at least one set of anti-parallel light emitting diode strings which is coupled with the fluorescent lamp ballast.

In another aspect, the present application provides a light emitting diode lamp coupled with a fluorescent lamp ballast, including: at least one first light emitting diode lamp and/or at least one second light emitting diode lamp; wherein the first light emitting diode lamp includes a rectifying and filtering circuit and at least one light emitting diode string coupled with the fluorescent lamp ballast; wherein the second light emitting diode lamp includes at least one set of anti-parallel light emitting diode strings which is coupled with the fluorescent lamp ballast.

When reinstalling a conventional fluorescent lamp lighting device into a LED lighting device, the present application may reduce the cost of reinstallation and greatly facilitate the user by directly replacing a conventional fluorescent lamp tube with a properly designed LED lamp without any other modifications.

The aforesaid and other aims, features and advantages of the present application will be more apparent through the depiction of the embodiments of the present application referring to the accompanying drawings.

BRIEF DESCRIPTION OF THE DRAWING

The accompanying drawings are not intended to be drawn to scale. In the drawings, each identical or nearly identical component that is illustrated in various figures is represented by a like numeral. Fur purposes of clarity, not every component may be labeled in every drawing. In the drawings.

DESCRIPTION OF THE EMBODIMENTS

Hereinafter, the embodiments of the present application will be described with reference to the accompanying drawings. It should be noted that the embodiments described herein are only intended for illustration, but not for limiting the present application.

In the present embodiment, when reinstalling a conventional fluorescent lamp lighting device into a LED lighting device, a conventional fluorescent lamp ballast is remained and a conventional fluorescent lamp is directly replaced by a properly designed LED lamp without any other modifications, thus the present embodiment may reduce the cost of reinstallation and greatly facilitate the user. Now, the embodiments of the present application will be described with reference to the accompanying drawings and some specific embodiments.

First Embodiment

Figure 1:
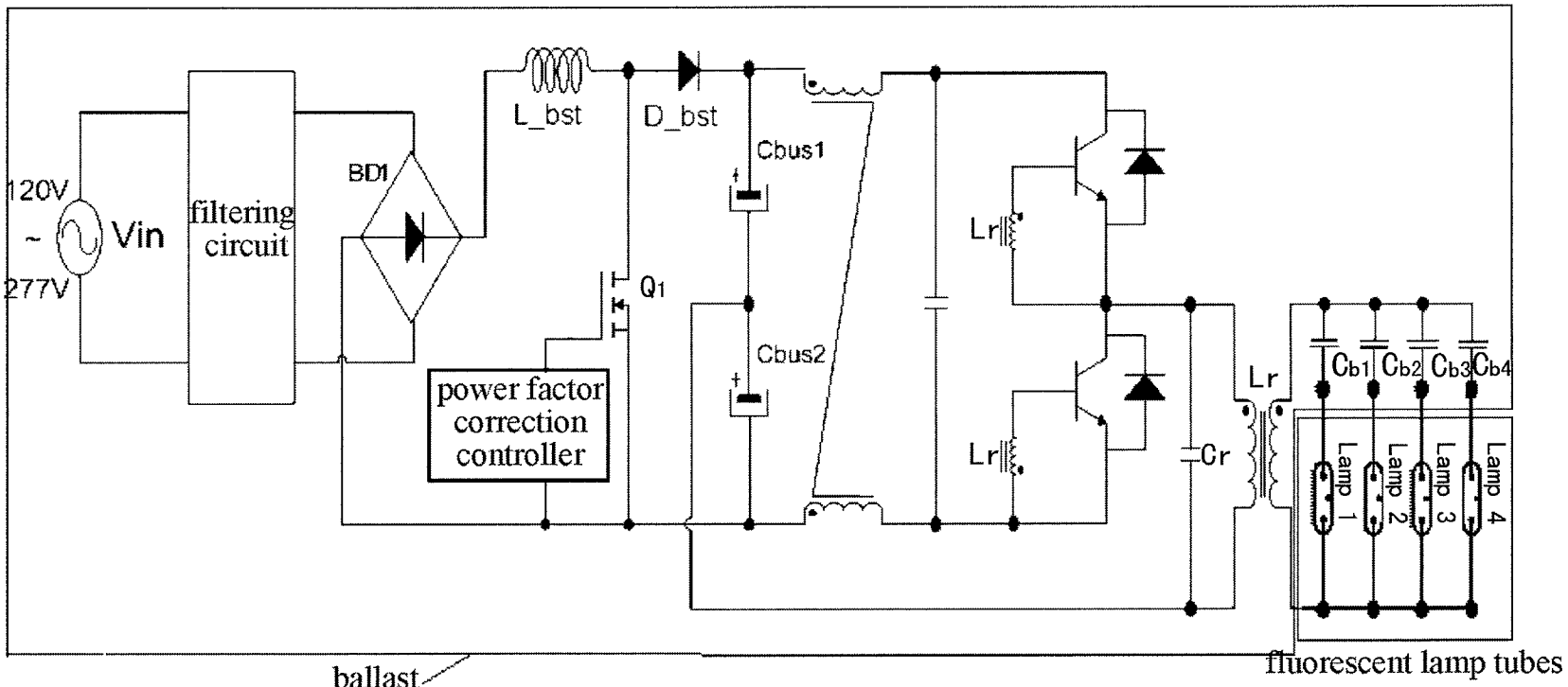
BACKGROUND ART Fig. 1
FIG. 1 illustrates a schematic diagram exemplifying a conventional fluorescent lamp.
Figure 2:
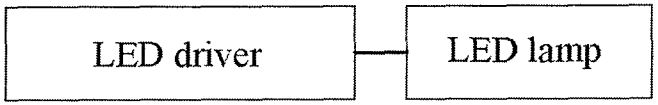
BACKGROUND ART Fig.2
FIG. 2 illustrates a schematic block diagram of a reinstalled LED lighting device in the background art.
Figure 3:
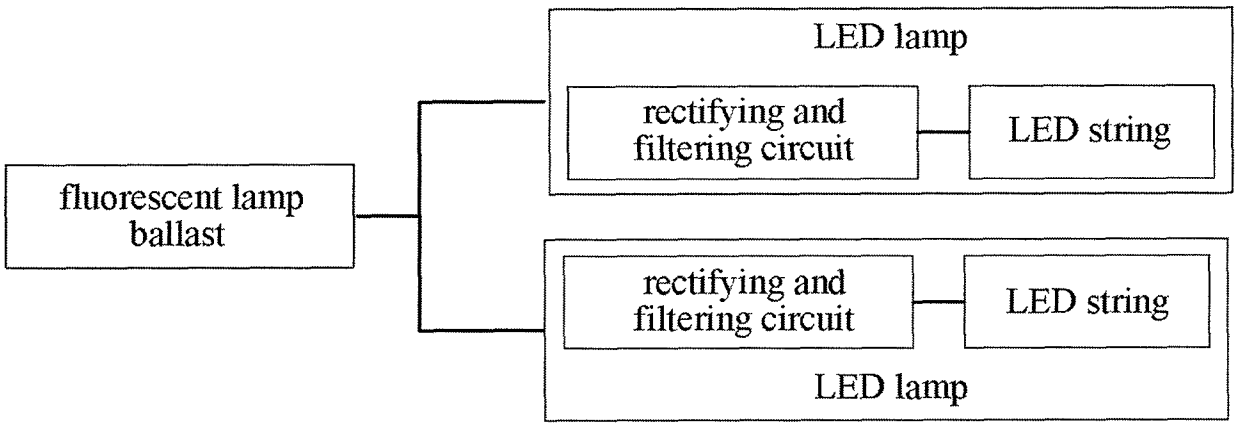
FIG. 3 illustrates a schematic block diagram of a LED lighting device according to the first embodiment.

A LED lighting device in this embodiment includes a fluorescent lamp ballast and at least one LED lamp coupled with the fluorescent lamp ballast. The LED lighting device may be suitable for the cases which have higher requirements for current ripples going through the LED lamps. For convenience of depiction, an exemplary LED lighting device of this embodiment is shown in FIG. 3. In FIG. 3, the LED lighting device includes two LED lamps, each of which includes a rectifying and filtering circuit and at least one LED string coupled with the rectifying and filtering circuit. The LED string includes one or more LEDs. In the case that the LED string includes more than one LEDs, in one embodiment, the more than one LEDs are connected in series and/or parallel. The fluorescent lamp ballast is used to output an alternating current (AC) to the LED lamps, and the alternating current is rectified and filtered through the rectifying and filtering circuit and then supplied to the LED strings. It should be explained that in the LED lighting device provided by the present embodiment, the number of the LED lamps depends on the proportional relation between the power of the fluorescent lamp ballast and the power of the LED lamp. When the power of the fluorescent lamp ballast is high, more LED lamps can be driven by the fluorescent lamp ballast.

Figure 4:
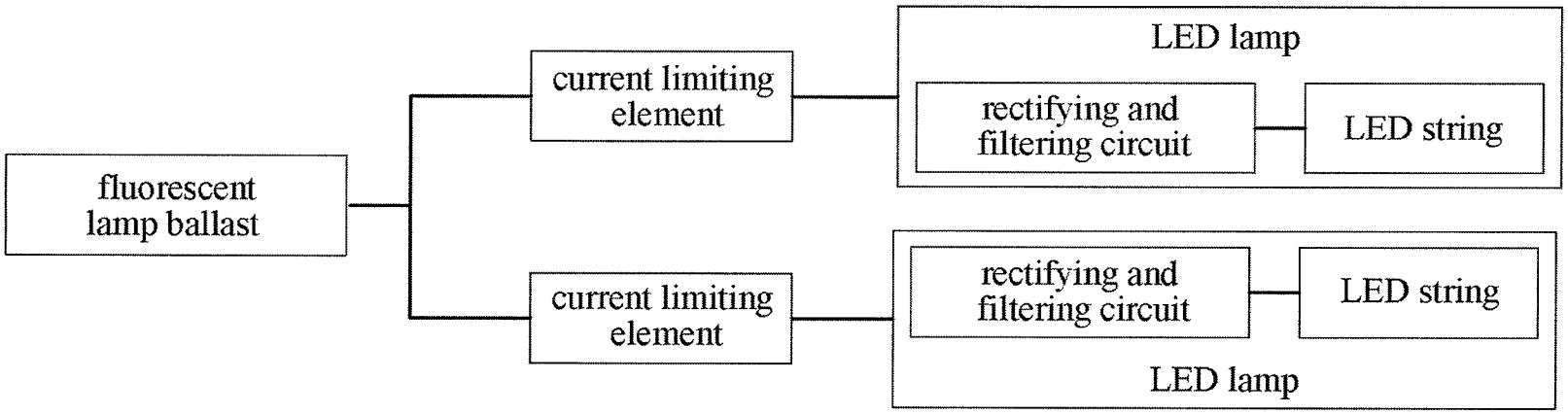
FIG. 4 illustrates a schematic block diagram of a LED lighting device coupled with current limiting elements according to the first embodiment.

Furthermore, it is considered that since the original operating current of the ballast is designed for the fluorescent lamp, an operating current of the LED lamp may undesirably be larger or smaller when the fluorescent lamp ballast is connected with the LED lamp. Therefore, to meet the requirements for the current of the LED lamp, as illustrated in FIG. 4, a current limiting element is arranged between the fluorescent lamp ballast and the LED lamp for adjusting the operating current of the LED lamp. The current limiting element is an inductor and/or a capacitor and/or a resistor, etc.

Figure 5A:
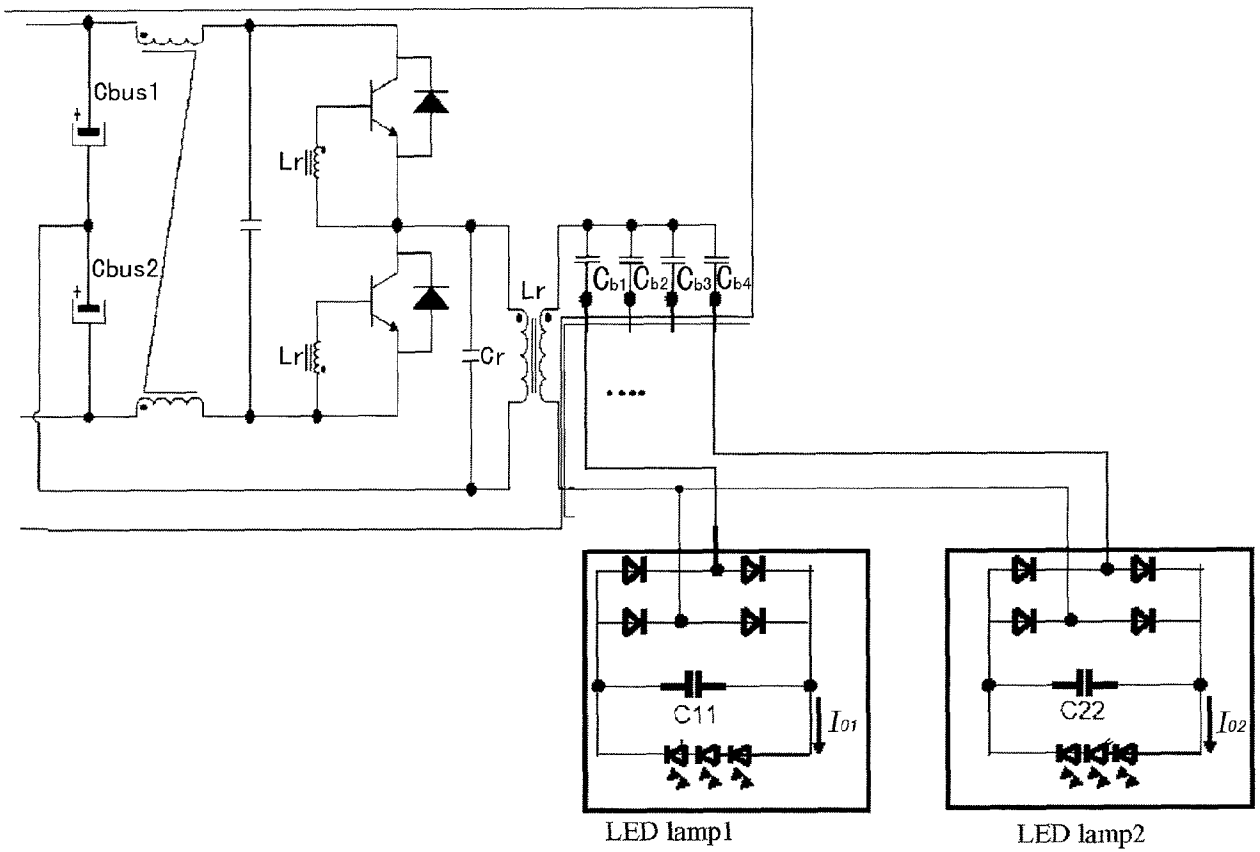
FIGS. 5A and 5B illustrate schematic diagrams of the LED lighting device shown in FIG. 3.
Figure 5B:
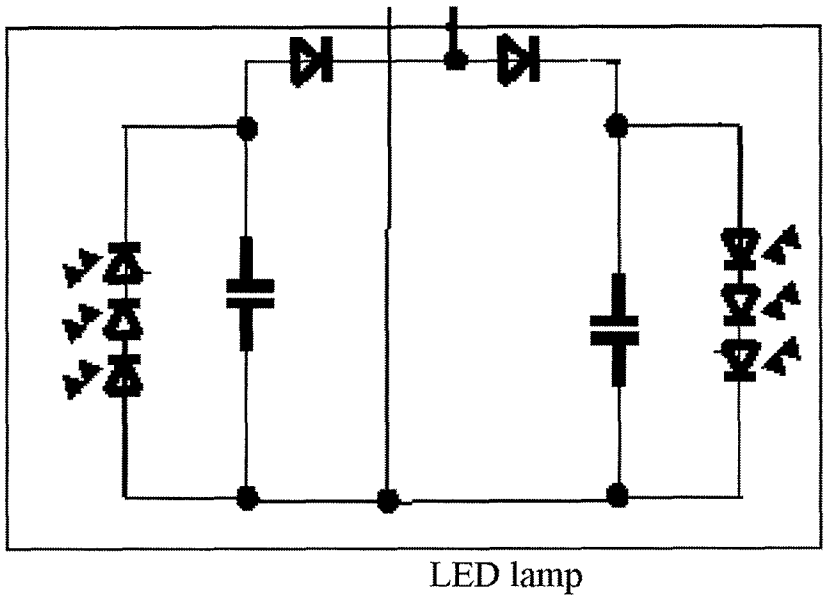

FIG. 5A is an exemplary schematic diagram of the LED lighting device shown in FIG. 3. For convenience of illustration, a power factor correction controller is not shown. In FIG. 5A, in order to match the LED lamp to the fluorescent lamp ballast, some appropriate modifications are made to the conventional LED lamps. The modified LED lamps include a rectifier bridge, a filter capacitor, and a LED string. The rectifier bridge is coupled with the fluorescent lamp ballast, the rectifier bridge and the corresponding filter capacitor (C11 or C22) constitute the rectifying and filtering circuit, and the LED string is coupled with the corresponding rectifier bridge and the filter capacitor. The rectifier bridge is used to convert the alternating current supplied from the fluorescent lamp ballast into a direct current (DC). Preferably, the direct current may be filtered by the filter capacitor and then provided to the LED strings. When the capacitor Cb1=Cb4, a current $I_{01}$ of one LED lamp equals to a current $I_{02}$ of the other LED lamp ($I_{01}=I_{02}$), i.e., the luminance of the two LED lamps are the same. If there is no strict requirement to the current ripple going through the LED lamp, the filter capacitor may be removed to reduce the cost of reinstallation. It should be explained that as shown in FIG. 5B (other elements are not shown), a single rectifier diode and a filter capacitor may be adopted to constitute the rectifying and filtering circuit. Moreover, although a half-bridge parallel resonant circuit (PRC) is adopted as the fluorescent lamp ballast in FIG. 5A, the conventional Push-Pull circuit is also applicable.

Figure 6:
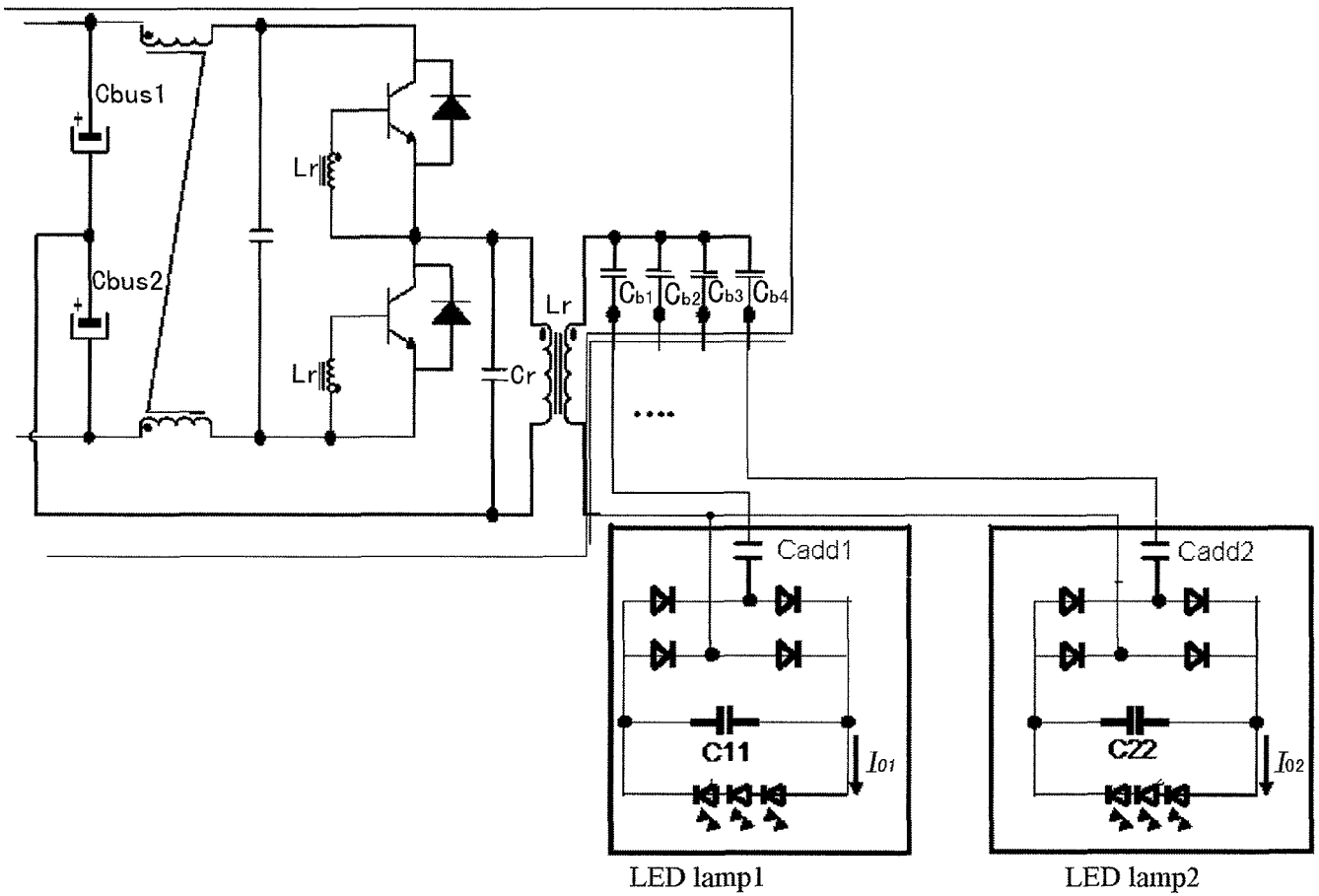
FIG. 6 illustrates a schematic diagram of the LED lighting device shown in FIG. 4.

Additionally, FIG. 6 is an exemplary schematic diagram of the LED lighting device shown in FIG. 4. In FIG. 6, a capacitor (Cadd1 or Cadd2) for limiting current is arranged between the fluorescent lamp ballast and the rectifier bridge. The larger the value of the capacitor is, the smaller the AC impedance of the capacitor is; conversely, the smaller the value of the capacitor is, the larger the AC impedance of the capacitor is. Therefore, the alternating current output by the fluorescent lamp ballast can be adjusted according to the requirements to the current of the LED lamp, such that how to directly replace every conventional fluorescent lamp may be labeled on the LED lamp.

Figure 7:
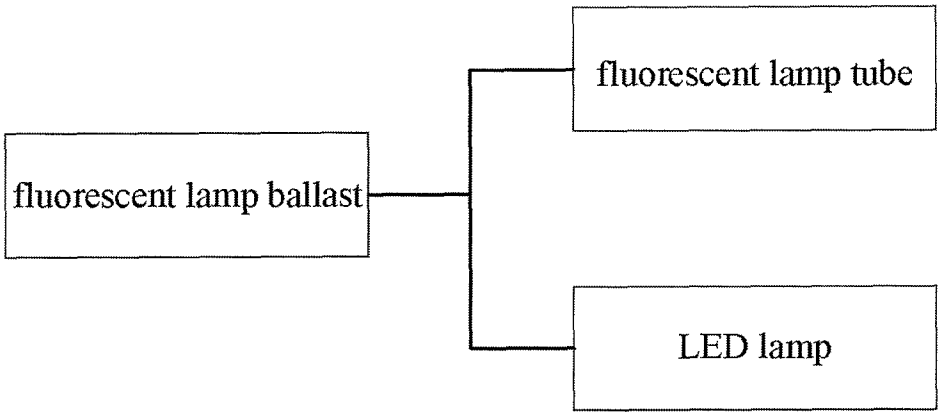
FIG. 7 illustrates a schematic block diagram of another LED lighting device according to the first embodiment.
Figure 8:
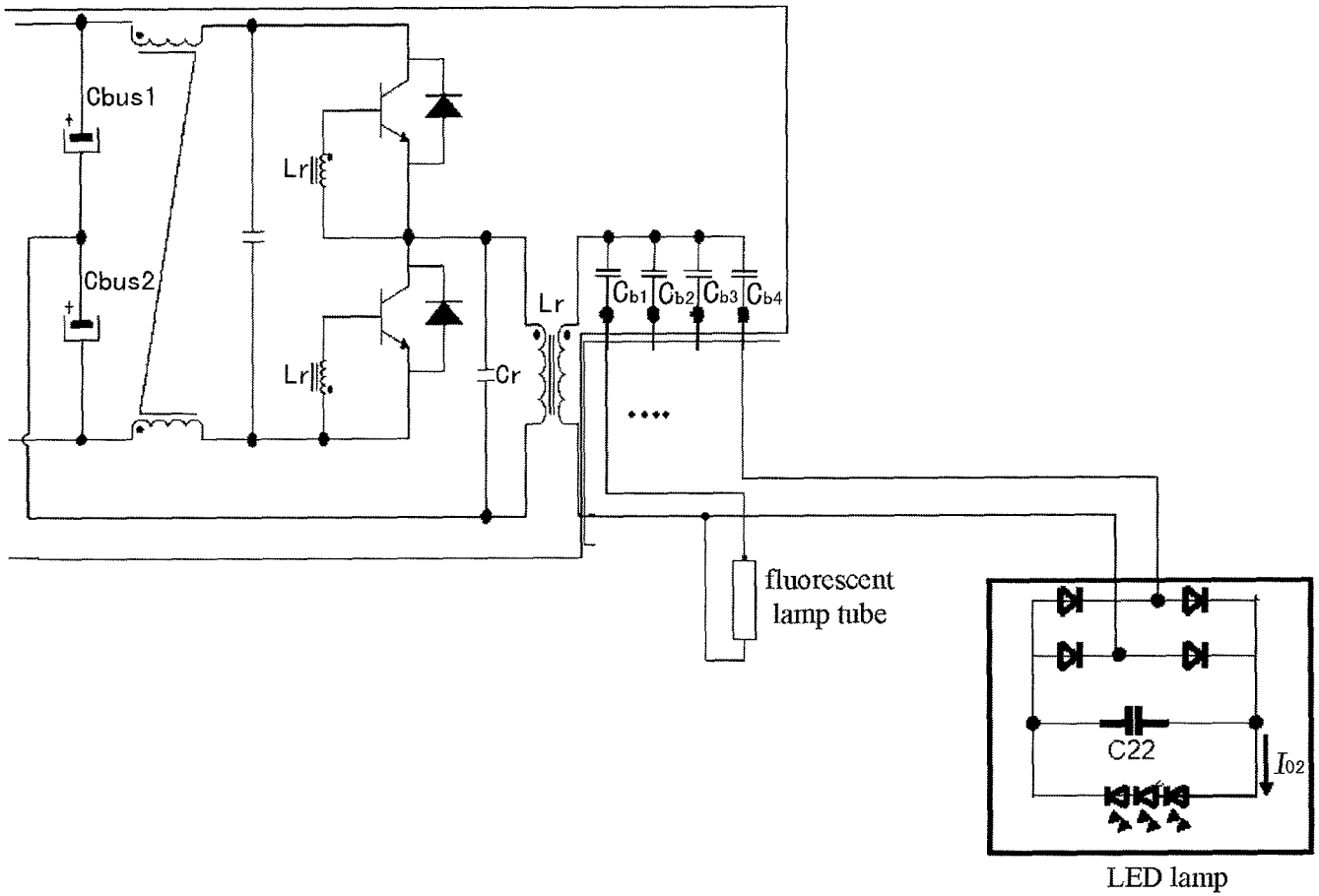
FIG. 8 illustrates a schematic diagram of the LED lighting device shown in FIG. 7.

Furthermore, as shown in FIG. 7, the LED lighting device may further include at least one fluorescent lamp tube in addition to the LED lamp. FIG. 8 is an exemplary schematic diagram of the LED lighting device shown in FIG. 7. In FIG. 8, the LED lighting device may further include one fluorescent lamp tube coupled with the fluorescent lamp ballast in addition to the LED lamp.

Those skilled in the art could understand, the number of LED lamps and/or the number of the fluorescent lamp tubes shown in FIG. 5A, FIG. 5B, FIG. 6, FIG. 7 and FIG. 8 are only exemplary, the number of the aforesaid elements may be adjusted in accordance with practical applications without departing from the protection scope and spirit of the present application.

To sum up, the user only needs to purchase the aforesaid properly designed LED lamp to replace the conventional fluorescent lamp tube without replacing the conventional fluorescent lamp ballast, thus, it may be convenient for the user to directly replace the fluorescent lamp with high performance LED lamp without modifying the existing wiring, thereby the cost of reinstallation may be reduced.

Second Embodiment

Figure 9:
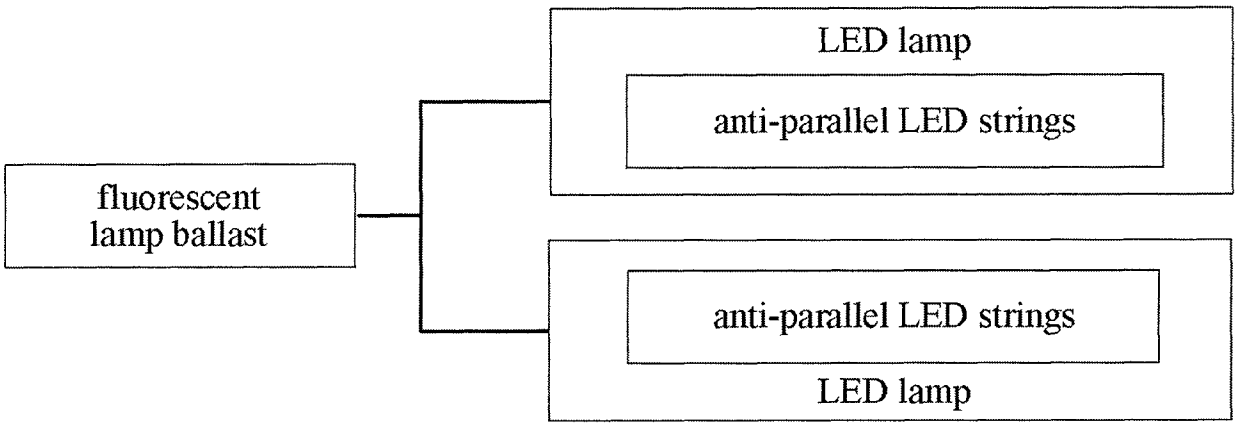
FIG. 9 illustrates a schematic block diagram of a LED lighting device according to the second embodiment.
Figure 10:
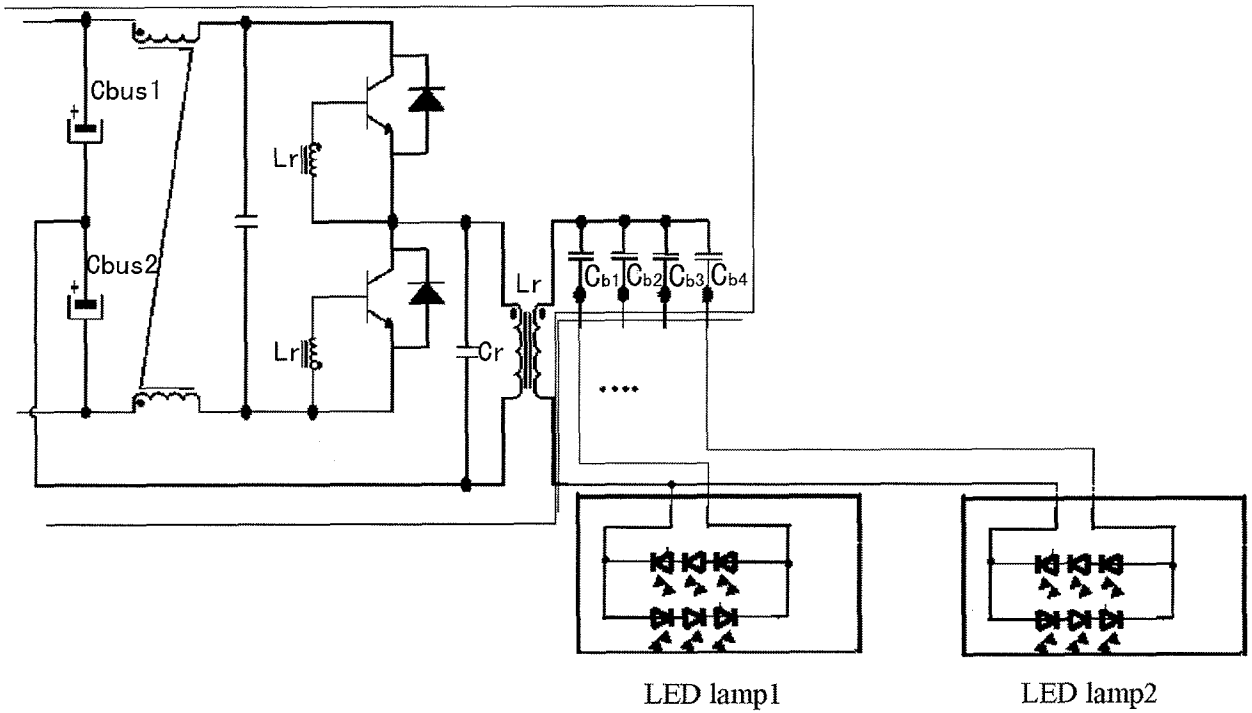
FIG. 10 illustrates a schematic diagram of the LED lighting device shown in FIG. 9.

Different from the first embodiment, as shown in FIG. 9, a LED lighting device of the present embodiment may be obtained by replacing the rectifying and filtering circuit of the LED lighting device provided in the first embodiment with one set of anti-parallel LED strings coupled with the fluorescent lamp ballast. In one embodiment, the one set of anti-parallel LED strings includes at least two LED strings, the at least two LED strings are divided into two groups arbitrarily, and the divided two groups of LED strings are anti-parallel connected, i.e., a positive terminal of the first group is connected to a negative terminal of the second group, and a negative terminal of the first group is connected to a positive terminal of the second group. The lighting device shown in FIG. 9 is applicable to a case in which larger ripple is allowable for the current going through the LED lamp. With such connection, the two LED strings alternatively operate in one AC cycle, thus rectifying and filtering circuit may be removed, and thereby the circuit may be simplified, and the cost may be reduced. Alternatively, a current limiting element for adjusting the current may be arranged between the ballast and the set of the anti-parallel LED strings in FIG. 9, and the current limiting element may be a capacitor, an inductor, or a resistor, etc. FIG. 10 is an exemplary schematic diagram of the LED lighting device shown in FIG. 9. For convenience of illustration, only two LED lamps are shown in FIG. 10, each including one set of anti-parallel LED strings. Furthermore, for convenience of the user, the LED lighting device shown in FIG. 10 may further include one fluorescent lamp tube. Similarly, those skilled in the art could understand, the number of the fluorescent lamp tubes and the number of the sets of the anti-parallel LED strings in the LED lighting device shown in FIG. 10 may be adjusted according to the actual requirements, and the protection scope of the application is not limited to the above-mentioned examples.

Third Embodiment

Figure 11:
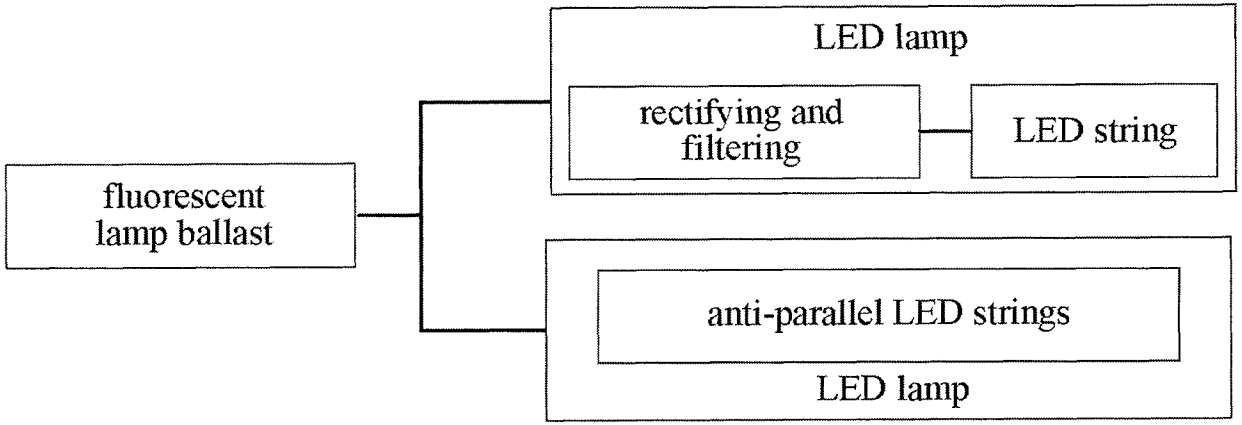
FIG. 11 illustrates a schematic block diagram of a LED lighting device according to the third embodiment.

As shown in FIG. 11, a LED lighting device, which is a combination of the lighting devices shown in both the first and second embodiments, is provided in this embodiment. In FIG. 11, the lighting device includes a first LED lamp and a second LED lamp which are coupled with a fluorescent lamp ballast. Alternatively, the lighting device may include at least one first LED lamp and at least one second LED lamp which are coupled with a fluorescent lamp ballast. The first LED lamp includes a rectifying and filtering circuit coupled with the fluorescent lamp ballast and at least one LED string coupled with the rectifying and filtering circuit. The second LED lamp includes two LED strings coupled with the fluorescent lamp ballast. Alternatively, the second LED lamp may include at least one set of LED strings coupled with the fluorescent lamp ballast. With reference to the aforesaid embodiments, the LED lighting device shown in FIG. 11 may include current limiting element(s) or fluorescent lamp tube(s).

Though the present application has been described by referring to typical embodiments, it should be understood that the terms used here are illustrative and exemplary, but not limitative terms. Those skilled in the art could understand, as the present application can be implemented in many forms without departing from the spirit or the substance thereof, the above embodiments are not limited to any aforesaid details, but shall be broadly explained within the spirit and scope defined by the appended claims. Thus, all the changes and modifications which fall into the scope of the claims or the equivalents intend to be covered by the appended claims.

What is claimed is:

1. A light emitting diode lighting device, comprising:

a fluorescent lamp ballast outputting an alternating current; and at least one light emitting diode lamp coupled with the fluorescent lamp ballast, wherein the light emitting diode lamp comprises a rectifying and filtering circuit and at least one light emitting diode string coupled with the rectifying and filtering circuit, and/or comprises at least one set of anti-parallel light emitting diode strings which are coupled with the fluorescent lamp ballast.

2. According to the light emitting diode lighting device of claim 1, wherein the rectifying and filtering circuit comprises:

a rectifier bridge coupled with the fluorescent lamp ballast; and a filter capacitor coupled with the rectifier bridge.

3. According to the light emitting diode lighting device of claim 1, further comprising:

a current limiting element coupled between the rectifying and filtering circuit and the fluorescent lamp ballast.

4. According to the light emitting diode lighting device of claim 3, wherein the current limiting element is a capacitor, an inductor or a resistor.

5. According to the light emitting diode lighting device of claim 1, further comprising:

a current limiting element coupled between the fluorescent lamp ballast and the at least one set of anti-parallel light emitting diode strings.

6. According to the light emitting diode lighting device of claim 5, wherein the current limiting element is a capacitor, an inductor or a resistor.

7. According to the light emitting diode lighting device of claim 1, further comprising:

at least one fluorescent lamp tube coupled with the fluorescent lamp ballast.

8. According to the light emitting diode lighting device of claim 1, wherein the fluorescent lamp ballast is a half-bridge parallel resonance circuit or a half-bridge Push-Pull circuit.

9. A light emitting diode lamp coupled with a fluorescent lamp ballast, comprising:

at least one first light emitting diode lamp comprising a rectifying and filtering circuit and at least one light emitting diode string coupled with the rectifying and filtering circuit.

10. According to the light emitting diode lamp of claim 9, further comprising at least one second light emitting diode lamp comprising at least one set of anti-parallel light emitting diode strings which is coupled with the fluorescent lamp ballast.

11. According to the light emitting diode lamp of claim 10, further comprising:

a current limiting element coupled between the fluorescent lamp ballast and the at least one set of anti-parallel light emitting diode strings.

12. According to the light emitting diode lamp of claim 11, wherein the current limiting element is a capacitor, an inductor or a resistor.

13. According to the light emitting diode lamp of claim 9, wherein the rectifying and filtering circuit comprises:

a rectifier bridge coupled with the fluorescent lamp ballast; and a filter capacitor coupled with the rectifier bridge.

14. According to the light emitting diode lamp of claim 9, further comprising:

a current limiting element coupled between the rectifying and filtering circuit and the fluorescent lamp ballast.

15. According to the light emitting diode lamp of claim 14, wherein the current limiting element is a capacitor, an inductor or a resistor.

16. A light emitting diode lamp coupled with a fluorescent lamp ballast, comprising:

at least one light emitting diode lamp comprising at least one set of anti-parallel light emitting diode strings which is coupled with the fluorescent lamp ballast.

17. According to the light emitting diode lamp of claim 16, further comprising:

a current limiting element coupled between the fluorescent lamp ballast and the at least one set of anti-parallel light emitting diode strings.

18. According to the light emitting diode lamp of claim 17, wherein the current limiting element is a capacitor, an inductor or a resistor.

* * * * *